US007566204B2

(12) United States Patent
Ogasawara et al.

(10) Patent No.: US 7,566,204 B2
(45) Date of Patent: Jul. 28, 2009

(54) MULTICYLINDRICAL ROTARY COMPRESSOR, COMPRESSION SYSTEM, AND FREEZING DEVICE USING THE COMPRESSION SYSTEM

(75) Inventors: Hirotsugu Ogasawara, Ota (JP); Takahiro Nishikawa, Gunma-ken (JP); Masayuki Hara, Ota (JP); Hiroyuki Yoshida, Ota (JP); Akira Hashimoto, Ota (JP)

(73) Assignee: Sanyo Electric Co., Ltd., Moriguchi-Shi (JP)

( * ) Notice: Subject to any disclaimer, the term of this patent is extended or adjusted under 35 U.S.C. 154(b) by 562 days.

(21) Appl. No.: 11/294,521

(22) Filed: Dec. 6, 2005

(65) Prior Publication Data

US 2006/0140802 A1 Jun. 29, 2006

(30) Foreign Application Priority Data

Dec. 13, 2004 (JP) ..... 2004-360061
Dec. 13, 2004 (JP) ..... 2004-360067

(51) Int. Cl.
*F04B 49/00* (2006.01)

(52) U.S. Cl. ..... 417/213; 417/212

(58) Field of Classification Search ..... 417/212, 417/213, 214, 216
See application file for complete search history.

(56) References Cited

U.S. PATENT DOCUMENTS 2,286,272 A * 6/1942 Higham ..... 417/372
5,170,636 A 12/1992 Hitosugi ..... 62/175
5,775,882 A * 7/1998 Kiyokawa et al. ..... 417/310
7,290,994 B2 * 11/2007 Kitaichi et al. ..... 418/60
2004/0009083 A1 1/2004 Kim et al. ..... 418/23
2004/0184922 A1 * 9/2004 Cho et al. ..... 417/212

FOREIGN PATENT DOCUMENTS

EP 1 577 557 9/2005
EP 1 614 902 1/2006

(Continued)

OTHER PUBLICATIONS

Patent Abstracts of Japan, vol. 011, No. 213 (M-605), Jul. 10, 1987, & JP 62 029788 (Mitsubishi Electric Corp.), Feb. 7, 1987.

(Continued)

*Primary Examiner*—William H Rodriguez
*Assistant Examiner*—Vikansha S Dwivedi
(74) *Attorney, Agent, or Firm*—Kratz, Quintos & Hanson, LLP

(57) ABSTRACT

In a multicylindrical rotary compressor constituted to be usable by urging an only first vane with respect to a first roller by means of a spring member to switch a first operation mode in which first and second rotary compression elements perform compression works and a second operation mode in which substantially the only first rotary compression element performs the compression work, an object is to reduce generation of collision noises due to collision of the second vane with the second roller at a time when the first operation mode is switched to the second operation mode, and a pressure in a back-pressure chamber of the second vane is discharged on a low-pressure chamber side in a second cylinder in a case where the first operation mode is switched to the second operation mode.

2 Claims, 11 Drawing Sheets

FOREIGN PATENT DOCUMENTS

| | | |
|---|---|---|
| EP | 1 617 082 | 1/2006 |
| JP | 58-77183 | 5/1983 |
| JP | 5-99172 | 4/1993 |
| JP | 05-157073 | 6/1993 |
| JP | 05-256286 | 10/1993 |
| JP | 2002-303284 | 10/2002 |
| JP | 2002-317784 | 10/2002 |
| JP | 2003-254276 | 9/2003 |
| JP | 2006-22723 | 1/2006 |

OTHER PUBLICATIONS

Patent Abstracts of Japan, vol. 2003, No. 12 Dec. 5, 2003, & JP 2003 254272 (Sanyo Electric Co. Ltd.), Sep. 10, 2003.

Patent Abstracts of Japan, vol. 011, No. 213, JP 62 029788, Mitsubishi Electric Corp., Feb. 2, 1987, 1 page.

Patent Abstracts of Japan, vol. 2003, No. 12, JP 2003 254272, Sanyo Electric Co. Ltd., Sep. 10, 2003, 1 page.

* cited by examiner

SECOND ROLLER IS POSITIONED IN TOP DEAD CENTER

SECOND ROLLER ROTATES BY 60° FROM TOP DEAD CENTER IN ROTATING DIRECTION

SECOND ROLLER ROTATES BY 70° FROM
TOP DEAD CENTER IN ROTATING DIRECTION

SECOND ROLLER ROTATES BY 90° FROM
TOP DEAD CENTER IN ROTATING DIRECTION

MULTICYLINDRICAL ROTARY COMPRESSOR, COMPRESSION SYSTEM, AND FREEZING DEVICE USING THE COMPRESSION SYSTEM

BACKGROUND OF THE INVENTION

The present invention relates to a multicylindrical rotary compressor constituted to be usable by switching a first operation mode in which first and second rotary compression elements perform compression works, and a second operation mode in which substantially the only first rotary compression element performs the compression work, a compression system provided with the multicylindrical rotary compressor, and a freezing device using the system.

Heretofore, this type of compression system is constituted of a multicylindrical rotary compressor, a control unit which controls an operation of the multicylindrical rotary compressor and the like. This multicylindrical rotary compressor, for example, a two-cylinder rotary compressor provided with first and second rotary compression elements is constituted by storing a driving element and the first and second rotary compression elements driven by a rotation shaft of the driving element in a sealed container. The first and second rotary compression elements include first and second cylinders, first and second rollers engaged with eccentric portions formed on the rotation shaft to rotate eccentrically in the respective cylinders, respectively, and first and second vanes which abut on the first and second rollers to divide each cylinder into low and high pressure chamber sides. The first and second vanes are constantly urged with respect to the first and second rollers by spring members.

Moreover, when the driving element is driven by the control unit, a low-pressure refrigerant gas is sucked from a suction passage into the low-pressure chamber side of the cylinder of each of the first and second rotary compression elements, and compressed by the operations of each roller and each vane to constitute the refrigerant gas at high temperature and pressure. After the gas is discharged from the high-pressure chamber side of each cylinder into a discharge sound muffling chamber via a discharge port, the gas is discharged into the sealed container, and discharged to the outside (see, e.g., Japanese Patent Application Laid-Open No. 5-99172).

In the compression system provided with such multicylindrical rotary compressor, in a case where compression operations are performed in both of the first and second cylinders in a small capability region at the time of a light load or low-speed rotation, the refrigerant gas has to be sucked as much as exhaust capacities of both of the cylinders, and compressed. Therefore, a rotation number of the driving element is lowered as much by the control unit to operate the system. However, a problem has occurred that when the rotation number excessively lowers, an operation efficiency of the driving element drops, a leakage loss increases, and a compression efficiency also drops.

Therefore, in view of such problem, a compression system is developed in which a one-cylinder operation and a two-cylinder operation are switchable depending on capability. That is, one of the spring members which urge the first and second vanes of the multicylindrical rotary compressor with respect to the first and second rollers, for example, the spring member which urges the second vane with respect to the second roller is removed, and a refrigerant pressure on a discharge side of each of the rotary compression elements is applied as a back pressure of the second vane by the control unit at the time of the two-cylinder operation. Accordingly, the second vane is urged on the side of the second roller, and the compression work is performed.

On the other hand, in the small capability region, the control unit applies the refrigerant pressure on a suction side of each of the rotary compression elements as the back pressure of the second vane. Since this suction pressure is a low pressure, the second vane cannot be urged on the second roller side. Therefore, the compression work is not substantially performed in the second rotary compression element, and the compression work of the refrigerant is performed by the only first rotary compression element.

As described above, when the one-cylinder operation is performed in the small capability region, an amount of the refrigerant gas to be compressed can be reduced, and the rotation number can be raised as much. Consequently, the operation efficiency of the driving element can be improved, and the leakage loss can be reduced.

However, in such constitution, when the two-cylinder operation is switched to the one-cylinder operation, the refrigerant pressure (high pressure) on the discharge side of each of the rotary compression elements, which has been applied as the back pressure of the second vane at the time of the two-cylinder operation, remains in a back-pressure chamber of the second vane. Much time is required until the inside of the back-pressure chamber of the second vane is switched to a low pressure. Therefore, the second vane does not easily retreat from the second cylinder, and this causes a disadvantage that the second vane collides with the second roller to generate a collision noise.

Moreover, the second rotary compression element which is not provided with the spring member has a problem that the refrigerant gas leaks from the second cylinder via a gap in the second vane during the two-cylinder operation. Especially at the time of low-speed rotation, a leak amount increases, and a remarkable drop of the compression efficiency is incurred.

SUMMARY OF THE INVENTION

The present invention has been developed to solve such conventional technical problem, and an object thereof is to reduce collision noises of a second vane at a time when a first operation mode is switched to a second operation mode in a compression system provided with multicylindrical rotary compression elements constituted to be usable by urging an only first vane with respect to a first roller by a spring member to switch the first operation mode in which both of the rotary compression elements perform a compression work and the second operation mode in which substantially the only first rotary compression element performs the compression work.

Another object is to improve a compression efficiency in the second rotary compression element and enhance a performance.

A first aspect of the present invention is directed to a multicylindrical rotary compressor comprising a sealed container in which a driving element and first and second rotary compression elements driven by a rotation shaft of the driving element are contained, the first and second rotary compression elements including first and second cylinders; first and second rollers engaged with eccentric portions formed on the rotation shaft to rotate eccentrically in the respective cylinders, respectively; and first and second vanes which abut on the first and second rollers to divide each cylinder into a low-pressure chamber side and a high-pressure chamber side, the compressor being constituted to be usable by urging the only first vane with respect to the first roller by means of a spring member, and switching a pressure to be applied to a back-pressure chamber of the second vane to switch a first operation mode in which both of the rotary compression elements perform compression works and a second operation mode in which substantially the only first rotary compression element performs the compression work, wherein the pressure in the back-pressure chamber of the second vane is discharged to the low-pressure chamber side in the second cylinder in a case where the first operation mode is switched to the second operation mode.

A second aspect of the present invention is directed to the multicylindrical rotary compressor of the first aspect of the present invention, which further comprises a communication path which connects the low-pressure chamber side in the second cylinder to the back-pressure chamber of the second vane, this communication path being connected only in an predetermined rotation region of the second roller.

According to the first aspect of the present invention, when the first operation mode is switched to the second operation mode, the pressure in the back-pressure chamber of the second vane is discharged on the low-pressure chamber side in the second cylinder. Therefore, for example, when there is disposed the communication path connected in the only predetermined rotation region of the second roller as in the second aspect of the present invention, and the pressure in the back-pressure chamber of the second vane is discharged to the low-pressure chamber side in the second cylinder, the pressure in the back-pressure chamber of the second vane can be released to the low-pressure chamber side in the second cylinder.

Consequently, since the pressure in the back-pressure chamber of the second vane can be quickly lowered, the second vane can be retreated from the second cylinder early, and it is possible to reduce generation of collision between the second vane and the second roller.

Therefore, noises at a time when the first operation mode is switched to the second operation mode can be reduced, and reliability of the multicylindrical rotary compressor can be enhanced.

A third aspect of the present invention is directed to a compression system comprising a multicylindrical rotary compressor provided with a sealed container in which a driving element and first and second rotary compression elements driven by a rotation shaft of the driving element are contained, the first and second rotary compression elements including first and second cylinders; first and second rollers engaged with eccentric portions formed on the rotation shaft to rotate eccentrically in the respective cylinders, respectively; and first and second vanes which abut on the first and second rollers to divide each cylinder into a low-pressure chamber side and a high-pressure chamber side, the compressor being constituted to be usable by urging the only first vane with respect to the first roller by means of a spring member to switch a first operation mode in which both of the rotary compression elements perform compression works and a second operation mode in which substantially the only first rotary compression element performs the compression work, wherein an oil of an oil reservoir in the sealed container is supplied to a back-pressure chamber of the second vane in the first operation mode, and a suction-side pressure of the first rotary compression element is applied to the back-pressure chamber of the second vane in the second operation mode.

A fourth aspect of the present invention is directed to the multicylindrical rotary compressor of the third aspect of the present invention, wherein a refrigerant compressed by the first and second rotary compression elements is discharged into the sealed container.

A fifth aspect of the present invention is directed to a freezing device wherein a refrigerant circuit is constituted using the compression system according to the third or fourth aspect of the present invention.

According to the third aspect of the present invention, since the oil of the oil reservoir in the sealed container is supplied to the back-pressure chamber of the second vane in the first operation mode, it is possible to reduce leakages of a refrigerant gas from gaps of the second vane.

Moreover, it is possible to reduce the collision noises of the second vane by the oil of the back-pressure chamber at the time when the first operation mode is switched to the second operation mode.

Furthermore, when the refrigerant compressed by the first and second rotary compression elements is discharged into the sealed container, the oil can be easily supplied to the back-pressure chamber owing to a pressure difference.

Additionally, even in a case where the oil supplied to the back-pressure chamber leaks into the second cylinder, when the refrigerant gas in the second cylinder is discharged into the sealed container, the mixed oil can be separated. Therefore, it is possible to reduce oil discharge to the outside of the multicylindrical rotary compressor.

Moreover, as described above, it is possible to enhance performance and reliability of the multicylindrical rotary compressor constituted to be usable by switching the first operation mode in which the first and second rotary compression elements perform the compression work and the second operation mode in which substantially the only first rotary compression element performs the compression work. The performance of the compression system can be remarkably enhanced.

Furthermore, since the refrigerant circuit of the freezing device is constituted using the compression system according to the above-described aspects of the present invention, it is possible to improve an operation efficiency and performance of the whole freezing device.

DETAILED DESCRIPTION OF THE PREFERRED EMBODIMENT

Embodiments of the present invention will be described hereinafter in detail with reference to the drawings.

Embodiment 1

Figure 1:
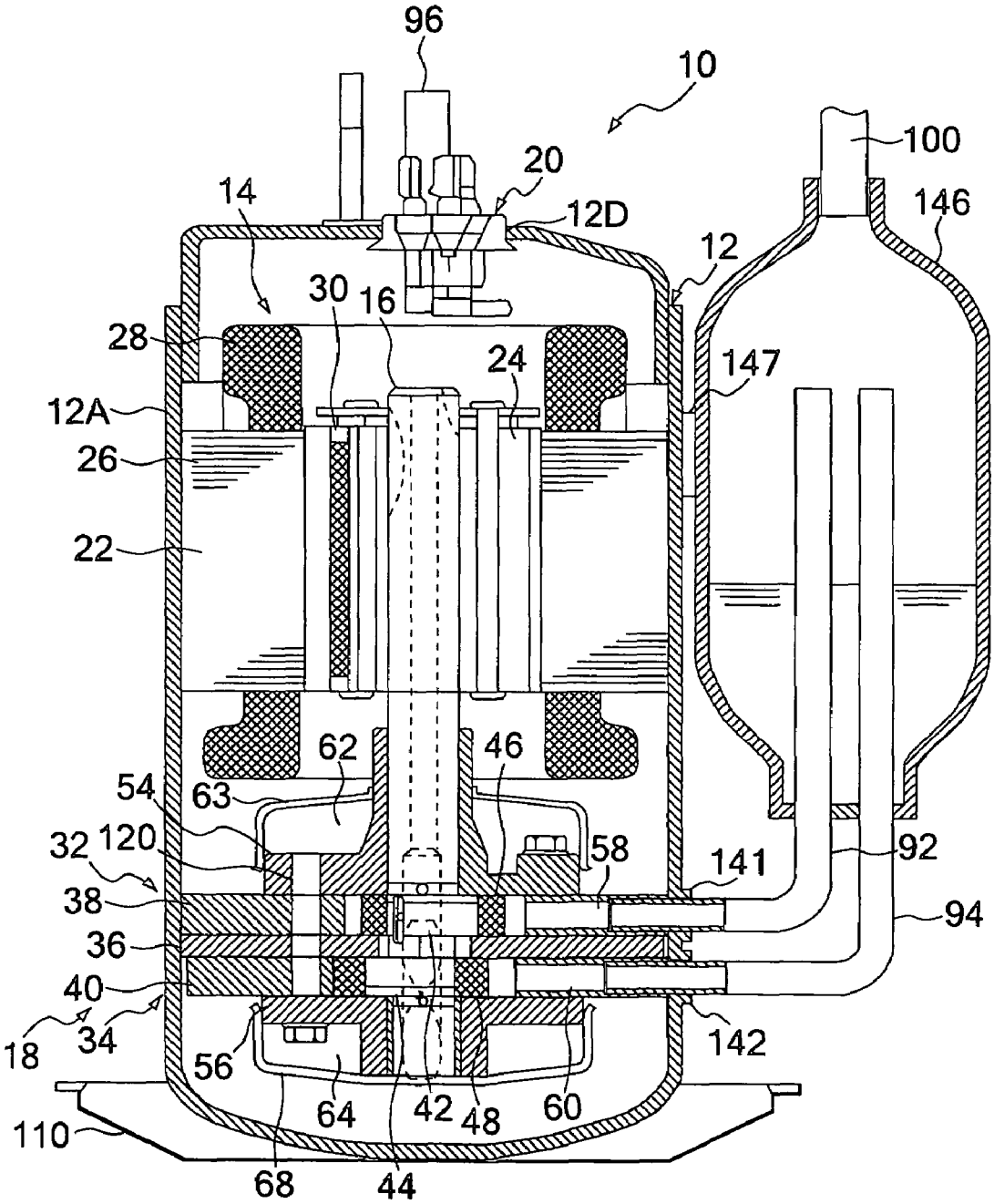
FIG. 1 is a vertical side view of a multicylindrical rotary compressor of a compression system according to one embodiment of the present invention.
Figure 2:
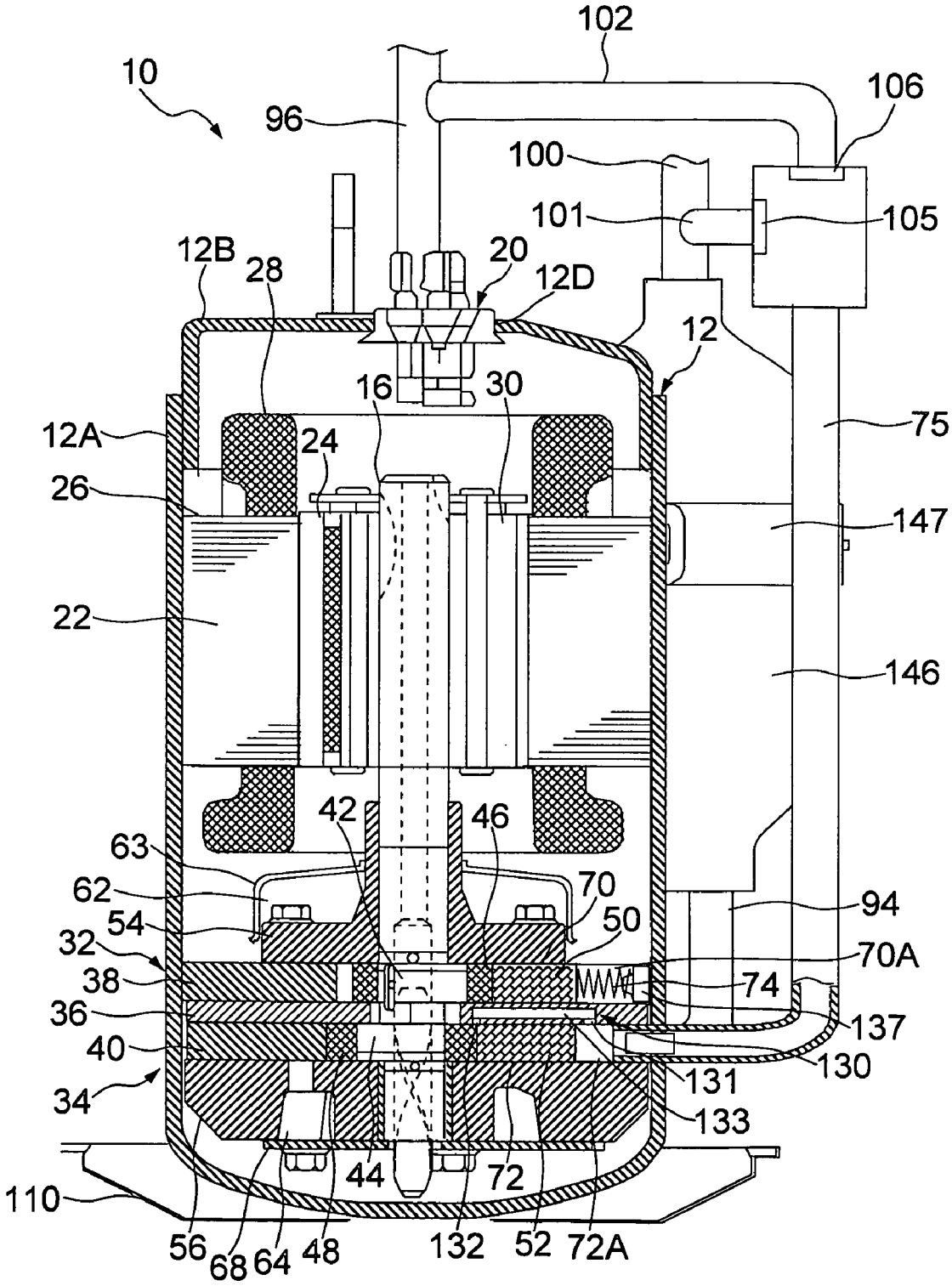
FIG. 2 is another vertical side view of the multicylindrical rotary compressor of FIG. 1.
Figure 3:
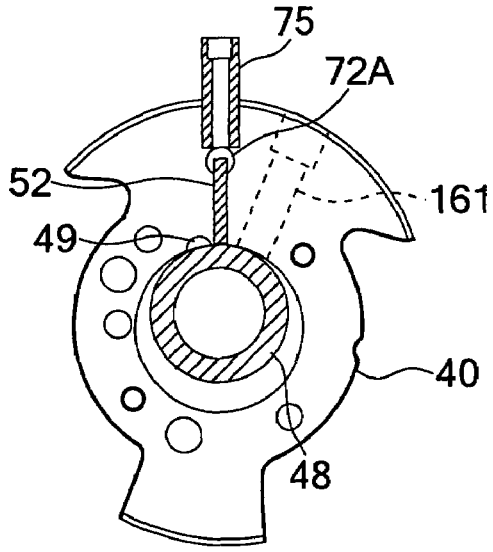
FIG. 3 is a sectional plan view of a second cylinder in a case where a second roller of a second rotary compression element is positioned in a top dead center in the multicylindrical rotary compressor of FIG. 1.

FIG. 1 shows a vertical side view of a high inner pressure type rotary compressor 10 provided with first and second rotary compression elements according to an embodiment of a multicylindrical rotary compressor of the present invention, FIG. 2 shows a vertical side view (showing a section different from that of FIG. 1) of the rotary compressor 10 of FIG. 1, and FIG. 3 shows a sectional plan view of a second cylinder 40 of a second rotary compression element 34. It is to be noted that the rotary compressor 10 of the present embodiment constitutes a part of a refrigerant circuit of an air conditioner as a freezing device which conditions air in a room.

In each drawing, the rotary compressor 10 of the present embodiment is the high inner pressure type rotary compressor. In a vertically cylindrical sealed container 12 made of a steel plate, there are stored an electromotive element 14 as a driving element disposed in an upper part of an inner space of this sealed container 12; and a rotary compression mechanism portion 18 disposed under this electromotive element 14 and constituted of first and second rotary compression elements 32, 34 driven by a rotation shaft 16 of the electromotive element 14.

The sealed container 12 is constituted of a container main body 12A whose bottom portion is constituted as an oil reservoir and in which the electromotive element 14 and the rotary compression mechanism portion 18 are stored; and a substantially cup shaped end cap (lid member) 12B to close an upper opening of the container main body 12A. Moreover, a circular attaching hole 12D is formed in the upper surface of this end cap 12B, and a terminal (wiring line is omitted) 20 for supplying power to the electromotive element 14 is attached to the attaching hole 12D.

Moreover, a refrigerant discharge tube 96 is attached to the end cap 12B, and one end of the refrigerant discharge tube 96 communicates with the sealed container 12. Furthermore, a bottom part of the sealed container 12 is provided with an attaching base 110.

The electromotive element 14 is constituted of a stator 22 welded and fixed in an annular form along an inner peripheral surface of an upper space of the sealed container 12; and a rotor 24 inserted with a slight interval inside this stator 22. This rotor 24 is fixed to the rotation shaft 16 which passes through the element and extends in a vertical direction.

The stator 22 has a laminate 26 constituted by laminating donut-shaped electromagnetic steel plates; and a stator coil 28 wound around a tooth portion of the laminate 26 by a direct winding (concentrated winding) system. The rotor 24 is constituted of a laminate 30 of electromagnetic steel plates in the same manner as in the stator 22.

An intermediate partition plate 36 is sandwiched between the first and second rotary compression elements 32, 34. That is, the first and second rotary compression elements 32, 34 are constituted of the intermediate partition plate 36; first and second cylinders 38, 40 disposed on and under this intermediate partition plate 36; first and second rollers 46, 48 fitted with upper and lower eccentric portions 42, 44 disposed on the rotation shaft 16 with a phase difference of 180 degrees in the first and second cylinders 38, 40 to rotate eccentrically in the respective cylinders 38, 40; first and second vanes 50, 52 whose tip portions abut on the first and second rollers 46, 48 to divide the respective cylinders 38, 40 into a low-pressure chamber side and a high-pressure chamber side, respectively; and an upper support member 54 and a lower support member 56 as support members which close an upper open surface of the first cylinder 38 and a lower open surface of the second cylinder 40 and which also function as bearings of the rotation shaft 16.

The first and second cylinders 38, 40 are provided with suction passages 58, 60 which communicate with the first and second cylinders 38, 40 via suction ports 161 (the suction port of the first rotary compression element 32 is not shown). The suction passages 58, 60 are connected to refrigerant introducing pipes 92, 94 described later.

Moreover, a discharge sound muffling chamber 62 is disposed above the upper support member 54, and the refrigerant gas compressed by the first rotary compression element 32 is discharged to the discharge sound muffling chamber 62. This discharge sound muffling chamber 62 is formed in a substantially cup-shaped member 63 whose center is provided with a hole for passing the rotation shaft 16 and the upper support member 54 also functioning as the bearing of the rotation shaft 16 and which covers the upper support member 54 on the side of the electromotive element 14 (upper side). Moreover, the electromotive element 14 is disposed above the cup member 63 with a predetermined interval from the cup member 63.

The lower support member 56 is provided with a discharge sound muffling chamber 64 formed by closing a recessed portion formed in a lower part of the lower support member 56 with a cover as a wall. That is, the discharge sound muffling chamber 64 is closed by a lower cover 68 which defines the discharge sound muffling chamber 64. It is to be noted that the high-pressure chamber sides of the respective cylinders 38, 40 communicate with the respective discharge sound muffling chambers 62, 64 via discharge ports 49 (the discharge port of the first rotary compression element 32 is not shown).

On the other hand, a guide groove 70 in which the first vane 50 is contained is formed in the first cylinder 38. A storage portion 70A in which a spring 74 as a spring member is stored is formed on a back-surface side of the first vane 50. This spring 74 abuts on an end portion of the first vane 50 on the back-surface side, and the first vane 50 is constantly urged on the side of the first roller 46. A discharge-side pressure (high pressure) in the sealed container 12 described later is also introduced into the storage portion 70A, and applied as a back pressure of the first vane 50. Moreover, this storage portion 70A opens on the sides of the guide groove 70 and the sealed container 12 (container main body 12A). A plug 137 made of a metal is disposed on the side of the sealed container 12 of the spring 74 stored in the storage portion 70A, and prevents the spring 74 from falling.

Moreover, the second cylinder 40 is provided with a guide groove 72 in which the second vane 52 is stored, and a back-pressure chamber 72A is formed outside this guide groove 72, that is, on a back-surface side of the second vane 52. This back-pressure chamber 72A opens on the sides of the guide groove 72 and the sealed container 12, and a pipe 75 described later is connected to an opening on the side of the sealed container 12 to seal the pipe and the sealed container 12.

Sleeves 141, 142 are welded and fixed to portions of the first and second cylinders 38, 40 corresponding to the suction passages 58, 60 on the side surface of the container main body 12A of the sealed container 12. Moreover, one end of the refrigerant introducing tube 92 for introducing the refrigerant gas into the first cylinder 38 is inserted into and connected to the sleeve 141, and one end of this refrigerant introducing tube 92 communicates with the suction passage 58 of the upper cylinder 38. The other end of the refrigerant introducing tube 92 opens in an accumulator 146.

One end of the refrigerant introducing tube 94 for introducing the refrigerant gas into the second cylinder 40 is inserted into the sleeve 142, and one end of this refrigerant introducing tube 94 communicates with the suction passage 60 of the second cylinder 40. The other end of the refrigerant introducing tube 94 opens in the accumulator 146 in the same manner as in the refrigerant introducing tube 92.

The accumulator 146 is a tank which separates a sucked refrigerant into a gas and a liquid, and attached to the side surface of an upper part of the container main body 12A of the sealed container 12 via a bracket 147. Moreover, the refrigerant introducing tubes 92, 94 are inserted into the accumulator 146 from a bottom part, and an opening of the other end of each tube is positioned in an upper part of the accumulator 146. One end of a refrigerant pipe 100 is inserted into the upper part of the accumulator 146.

It is to be noted that the discharge sound muffling chamber 64 communicates with the discharge sound muffling chamber 62 via a communication path 120 which passes through the first and second cylinders 38, 40 or the intermediate partition plate 36 in an axial center direction (vertical direction). Moreover, the high-temperature high-pressure refrigerant gas compressed by the second rotary compression element 34 and discharged to the discharge sound muffling chamber 64 is discharged to the discharge sound muffling chamber 62 via the communication path 120, and combined with the high-temperature high-pressure refrigerant gas compressed by the first rotary compression element 32.

Moreover, the discharge sound muffling chamber 62 communicates with the sealed container 12 via holes (not shown) which pass through the cup member 63, and the high-temperature high-pressure refrigerant gas compressed by the first and second rotary compression elements 32, 34 and discharged to the discharge sound muffling chamber 62 is discharged into the sealed container 12 via this hole.

On the other hand, a communication path 130 is formed in the intermediate partition plate 36. Here, the communication path 130 will be described with reference to FIGS. 2 to 8. FIGS. 3 to 6 show sectional plan views of the second cylinder 40 (showing the operations of the second vane 52 and the second roller 48 of the second rotary compression element 34), respectively. This communication path 130 is a passage for connecting the low-pressure chamber side in the second cylinder 40 to the back-pressure chamber 72A of the second vane 52. The communication path 130 is formed in the intermediate partition plate 36 in the axial center direction (vertical direction), and constituted of a passage 131 which communicates with the back-pressure chamber 72A in the upper surface of the back-pressure chamber 72A; a passage 132 which is formed in the axial center direction in the intermediate partition plate 36 in the same manner as in the passage 131 and which communicates with the low-pressure chamber side in the second cylinder 40 in the upper surface of the second cylinder 40; and a passage 133 which is formed in the intermediate partition plate 36 in a horizontal direction and which communicates with the passages 131 and 132. In the present embodiment, a diameter of each of the passages 131 and 133 is set to 1.5 mm, and a diameter of the passage 132 which communicates with the low-pressure chamber side in the second cylinder 40 is set to 0.7 mm which is smaller than the diameter of each of the passages 131 and 132. In a case where a tip portion of the second vane 52 abutting on the second roller 48 is connected to the center of the cylinder 40 with a straight line, the passage 132 is disposed in a position closable by the second vane 52 on the low-pressure chamber side (right side in FIGS. 3 to 8) from the straight line.

An opening 131A of the passage 131 is openably closed by the second vane 52. That is, in a case where the second roller 48 is positioned in a top dead center as shown in FIG. 3 or in the vicinity of the top dead center (the second roller 48 is positioned in a region from the top dead center to a position rotated by 30° from the top dead center in the present embodiment) by an urging operation of the second vane 52 with respect to the second roller 48 in a forward/backward direction, a part of the second vane 52 is positioned right under the opening 131A. Therefore, the opening 131A is closed by the second vane 52. When the second roller 48 leaves the vicinity of the top dead center (the roller rotates by 30° or more from the top dead center in the present embodiment), the second vane 52 is detached from the opening 131A, and the opening 131A is opened.

On the other hand, an opening 132A of the passage 132 is openably closed by the second vane 52 or the second roller 48. That is, in a case where the second roller 48 is positioned in the top dead center as shown in FIG. 3 or in the vicinity of the top dead center (the second roller 48 is positioned in a region from the top dead center to a position rotated by 60° from the top dead center in the present embodiment), a part of the second roller 48 is positioned right under the opening 132A, and the opening 132A is closed. When the second roller leaves the vicinity of the top dead center (the roller rotates by 70° or more from the top dead center in the present embodiment), a part of the second vane 52 is positioned right under the opening 132A, and the opening 132A is closed. Moreover, the openings 132A and 131A are opened, and connected to the communication path 130 only in a predetermined rotation region of the second roller 48 (only in a rotation angle range of 60° or more and less than 70° in a rotating direction in a case where the top dead center of the second roller 48 is assumed as 0° in the present embodiment).

Figure 7:
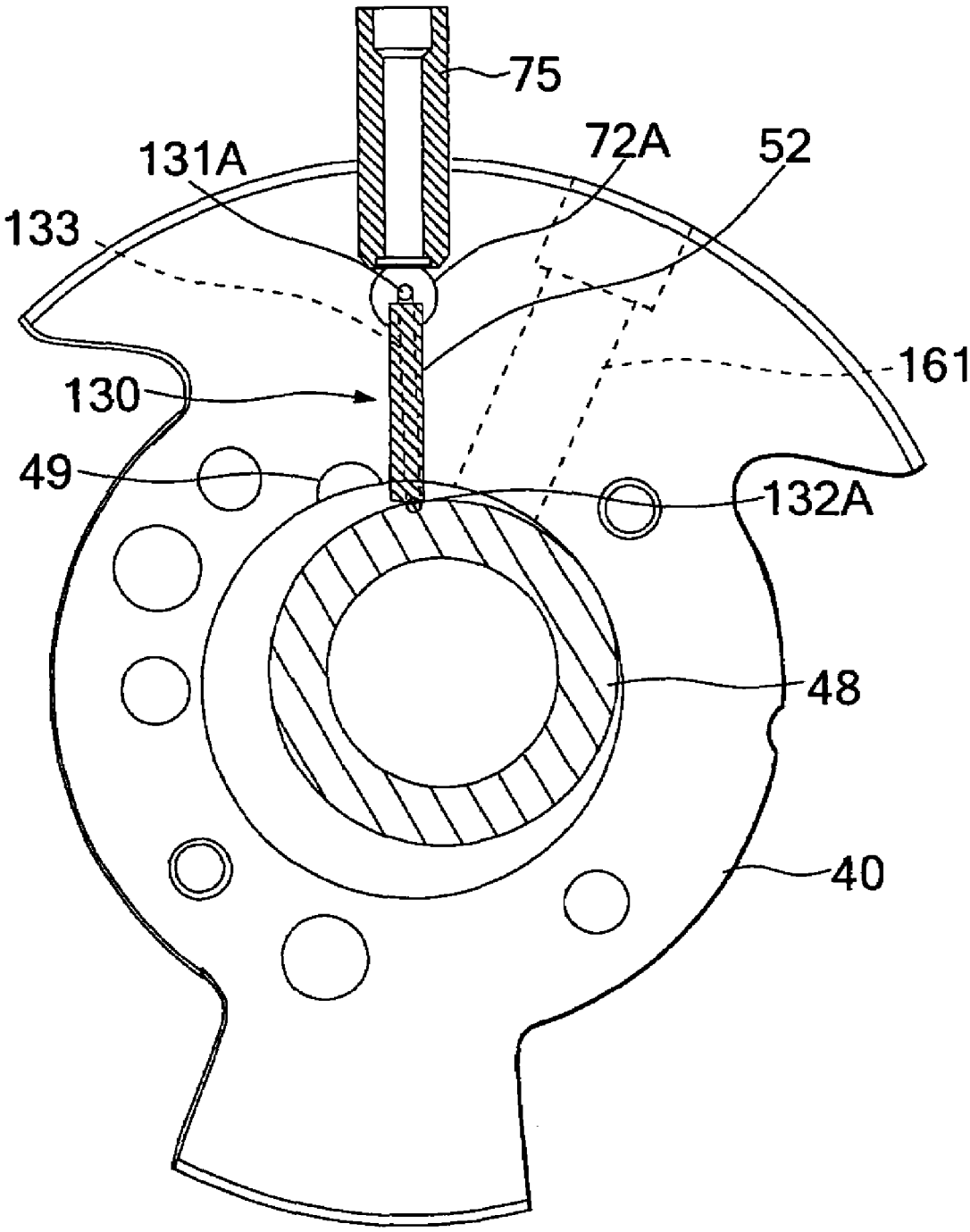
FIG. 7 is a diagram showing a positional relation between an opening of each passage and the second roller and second vane in a case where the second roller rotates by 60° from the top dead center.

In the present embodiment, when the second roller 48 rotates by 30° from the top dead center in a rotating direction, the opening 131A is opened by the second vane 52. Moreover, when the second roller 48 rotates by 60° from the top dead center in the rotating direction (FIG. 4), the opening 132A is opened by the second roller 48. Therefore, when the second roller 48 rotates by 60° from the top dead center, as shown in FIG. 7, both of the openings 131A, 132A are opened and connected to the communication path 130. It is to be noted that FIG. 7 is a diagram showing a positional relation between the openings 131A and 132A of the passages 131 and 132 formed in the intermediate partition plate 36 and the second roller 48 and second vane 52 in a case where the second roller 48 rotates by 60° from the top dead center.

Figure 5:
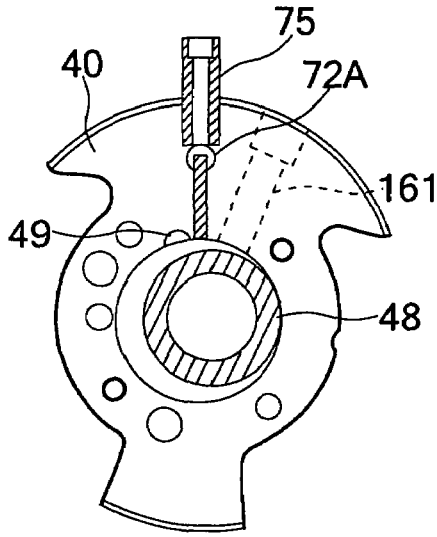
FIG. 5 is a sectional plan view of the second cylinder in a case where the second roller of the second rotary compression element rotates by 70° from the top dead center in the rotation direction in the multicylindrical rotary compressor of FIG. 1.
Figure 8:
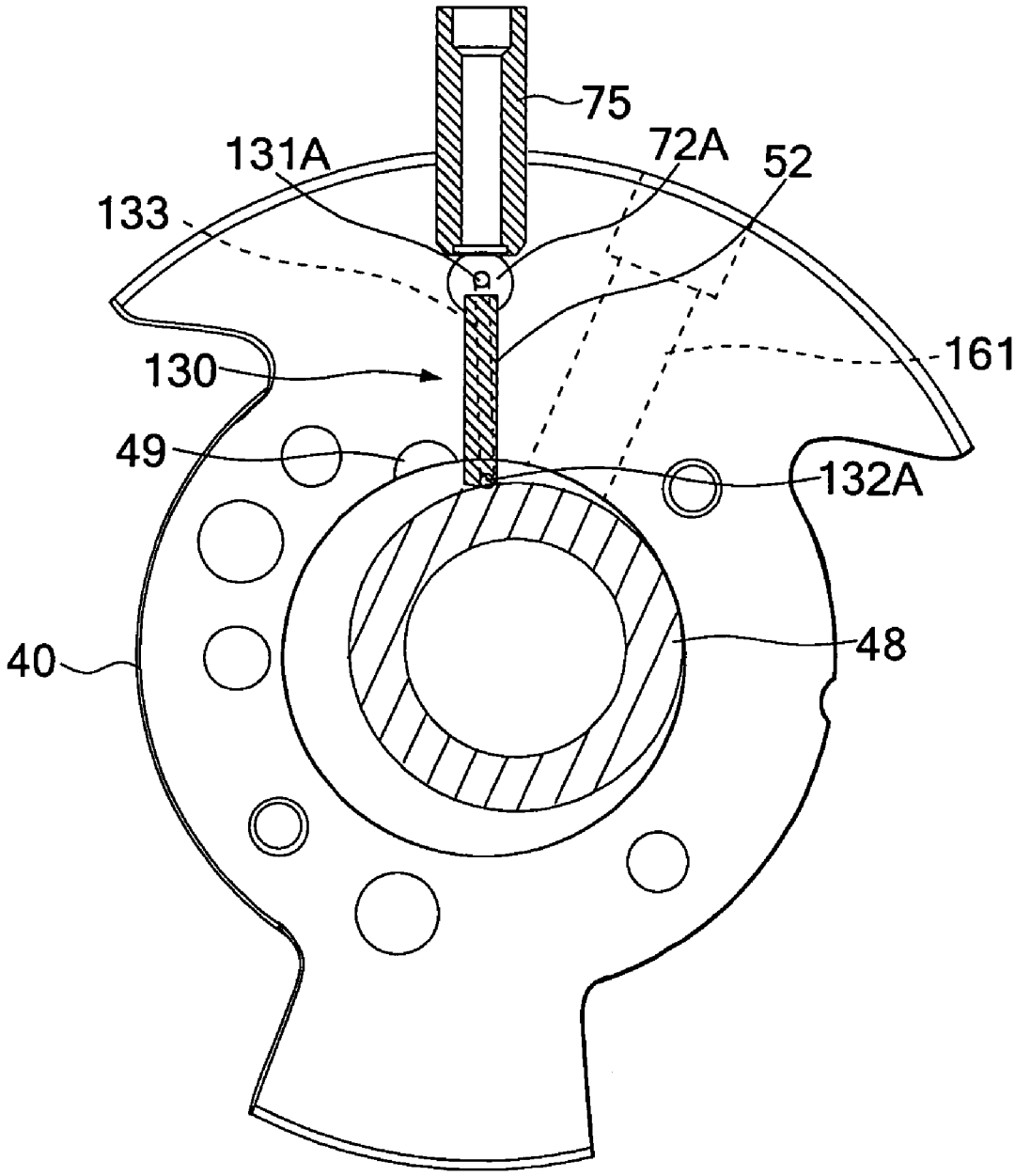
FIG. 8 is a diagram showing a positional relation between the opening of each passage and the second roller and second vane in a case where the second roller rotates by 70° from the top dead center.

Moreover, as shown in FIGS. 5 and 8, when the second roller 48 rotates by 70° from the top dead center, the opening 132A of the passage 132 is closed by the second vane 52, and the communication path 130 is closed. It is to be noted that FIG. 8 is a diagram showing a positional relation between the openings 131A and 132A of the passages 131 and 132 and the second roller 48 and second vane 52 in a case where the second roller 48 rotates by 70° from the top dead center.

On the other hand, a refrigerant pipe 101 is connected to an intermediate portion of the refrigerant pipe 100, and the pipe is connected to the pipe 75 via an electromagnetic valve 105. A refrigerant pipe 102 is also connected to an intermediate portion of the refrigerant discharge tube 96, and connected to the pipe 75 via an electromagnetic valve 106 in the same manner as in the refrigerant pipe 101. These electromagnetic valves 105, 106 are controlled to open/close by a controller 210 described later. That is, when the electromagnetic valve 105 is opened, and the electromagnetic valve 106 is closed by the controller 210, the refrigerant pipe 101 is connected to the pipe 75. Accordingly, a part of a suction-side refrigerant of each of the rotary compression elements 32, 34 (or the first rotary compression element 32), which has flown through the refrigerant pipe 100 into the accumulator 146, enters the refrigerant pipe 101, and flows from the pipe 75 into the back-pressure chamber 72A. Consequently, the suction-side pressure of each of the rotary compression elements 32, 34 (or the first rotary compression element 32) is applied as the back pressure of the second vane 52.

Moreover, when the electromagnetic valve 105 is closed, and the electromagnetic valve 106 is opened by the controller 210, the refrigerant discharge tube 96 is connected to the pipe 75. Accordingly, a part of a discharge-side refrigerant of each of the rotary compression elements 32, 34, discharged from the sealed container 12 through the refrigerant discharge tube 96, flows from the pipe 75 into the back-pressure chamber 72A via the refrigerant pipe 102. Accordingly, the discharge-side pressures of both of the rotary compression elements 32, 34 are applied as a back pressure of the second vane 52.

The controller 210 controls a rotation number of the electromotive element 14 of the rotary compressor 10. As described above, the electromagnetic valves 105, 106 of the refrigerant pipes 101, 106 are also controlled to open/close.

Figure 9:
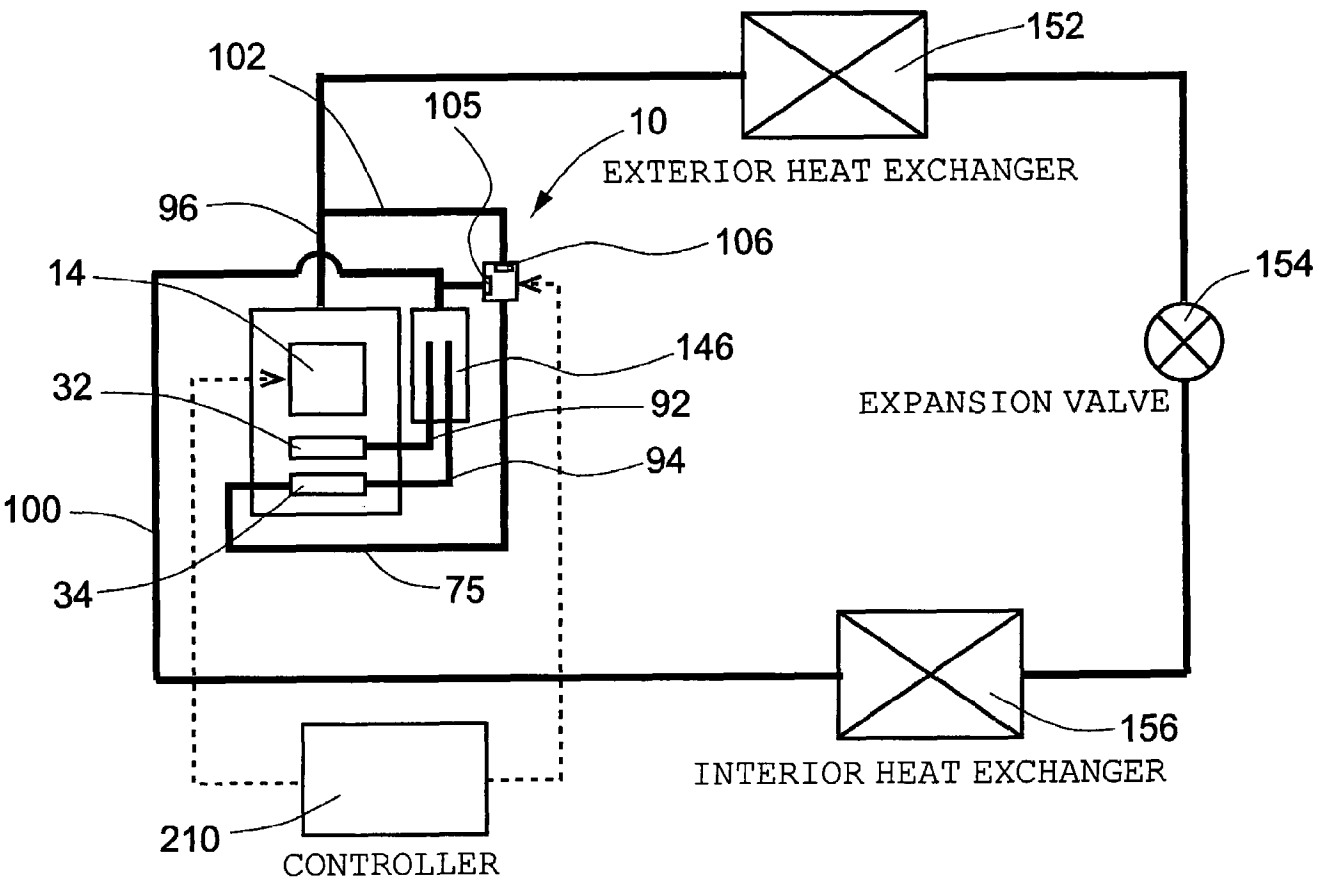
FIG. 9 is a refrigerant circuit diagram of an air conditioner using the multicylindrical rotary compressor of FIG. 1.

Next, FIG. 9 shows a refrigerant circuit diagram of an air conditioner constituted using the rotary compressor 10. That is, in the present embodiment, the rotary compressor 10 constitutes a part of the refrigerant circuit of the air conditioner shown in FIG. 9. The refrigerant discharge tube 96 of the rotary compressor 10 is connected to an inlet of an exterior heat exchanger 152. The controller 210, the rotary compressor 10, and the exterior heat exchanger 152 are disposed in an exterior unit (not shown) of the air conditioner. A pipe connected to an outlet of this exterior heat exchanger 152 is connected to an expansion valve 154 as pressure reducing means, and a pipe extending out of the expansion valve 154 is connected to an interior heat exchanger 156. The expansion valve 154 and the interior heat exchanger 156 are disposed in an interior unit (not shown) of the air conditioner. The interior heat exchanger 156 on an outlet side is connected to the refrigerant pipe 100 of the rotary compressor 10.

It is to be noted that an HFC or HC-based refrigerant is used as the refrigerant, and existing oil such as mineral oil, alkyl benzene oil, ether oil, or ester oil is used as the oil as a lubricant.

Next, an operation of the rotary compressor 10 constituted as described above will be described.

(1) First Operation Mode (at the Time of a Usual or High Load)

First, the first operation mode will be described in which both of the rotary compression elements 32, 34 perform compression works. In a case where the controller 210 controls the rotation number of the electromotive element 14 of the rotary compressor 10 based on an operation instruction input of an interior controller (not shown) disposed in the interior unit, and the interior has a usual or high load state, the controller 210 executes the first operation mode. In this first operation mode, the controller 210 closes the electromagnetic valve 105 of the refrigerant pipe 101, and opens the electromagnetic valve 106 of the refrigerant pipe 102. Accordingly, the refrigerant pipe 102 is connected to the pipe 75, the discharge-side refrigerants of both of the rotary compression elements 32, 34 flow into the back-pressure chamber 72A, and the discharge-side pressures of both of the rotary compression elements 32, 34 are applied as the back pressure of the second vane 52.

Furthermore, when the stator coil 28 of the electromotive element 14 is energized via the terminal 20 and a wiring line (not shown), the electromotive element 14 starts, and the rotor 24 rotates. This rotation engages first and second rollers 46, 48 with the upper and lower eccentric portions 42, 44 disposed integrally with the rotation shaft 16, and the rollers eccentrically rotate in the first and second cylinders 38, 40.

Accordingly, the low-pressure refrigerant flows from the refrigerant pipe 100 of the rotary compressor 10 into the accumulator 146. Since the electromagnetic valve 105 of the refrigerant pipe 100 is closed as described above, all the refrigerant passed through the refrigerant pipe 100 flows into the accumulator 146 without flowing into the pipe 75.

Moreover, the low-pressure refrigerant which has flown into the accumulator 146 is separated into a gas and a liquid. Thereafter, the only refrigerant gas enters the respective refrigerant discharge tubes 92, 94 which open in the accumulator 146. The low-pressure refrigerant gas which has entered the refrigerant introducing tube 92 is sucked into the first cylinder 38 of the first rotary compression element 32 on the low-pressure chamber side via the suction passage 58 and a suction port (not shown).

The refrigerant gas sucked into the first cylinder 38 on the low-pressure chamber side is compressed by the operations of the first roller 46 and the first vane 50 to constitute a high-temperature high-pressure refrigerant gas, and the gas is discharged from the high-pressure chamber side of the first cylinder 38 to the discharge sound muffling chamber 62 through a discharge port (not shown).

On the other hand, the low-pressure refrigerant gas which has entered the refrigerant introducing tube 94 is sucked into the second cylinder 40 of the second rotary compression element 34 on the low-pressure chamber side via the suction port 161. The refrigerant gas sucked into the second cylinder 40 on the low-pressure chamber side is compressed by the operations of the second roller 48 and the second vane 52.

At this time, since the discharge-side pressures of both of the rotary compression elements 32, 34 are applied as the back pressure to the second vane 52 as described above, the second vane 52 can sufficiently follow the second roller 48.

Here, a compressing operation of the second cylinder 40 of the second rotary compression element 34 will be described with reference to FIGS. 3 to 8. First, as shown in FIG. 3, when the second roller 48 rotates (the second roller 48 rotates clockwise in FIGS. 3 to 6) from the top dead center, and passes through the suction port 161, suction of the low-pressure refrigerant ends on the low-pressure chamber side in the second cylinder 40. Moreover, when the second roller 48 rotates by 30° from the top dead center, the opening 131A of the passage 131 closed by the second vane 52 is opened as described above. It is to be noted that at this time, since the opening 132A of the passage 132 communicating with the second cylinder 40 on the low-pressure chamber side is closed by the second roller 48, the communication path 130 is not connected yet.

Figure 4:
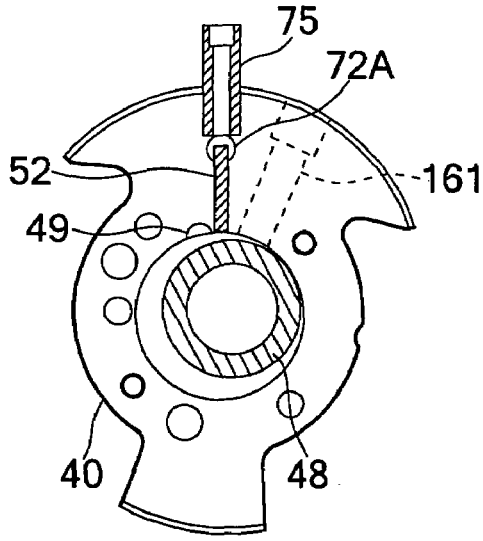
FIG. 4 is a sectional plan view of the second cylinder in a case where the second roller of the second rotary compression element rotates by 60° from the top dead center in a rotation direction in the multicylindrical rotary compressor of FIG. 1.

Moreover, as shown in FIGS. 4 and 7, when the second roller 48 rotates by 60° from the top dead center, the opening 132A of the passage 132 closed by the second roller 48 is opened, and connected to the communication path 130. Accordingly, the high-pressure refrigerant gas in the back-pressure chamber 72A is discharged to the low-pressure chamber side in the second cylinder 40 via the communication path 130.

Figure 6:
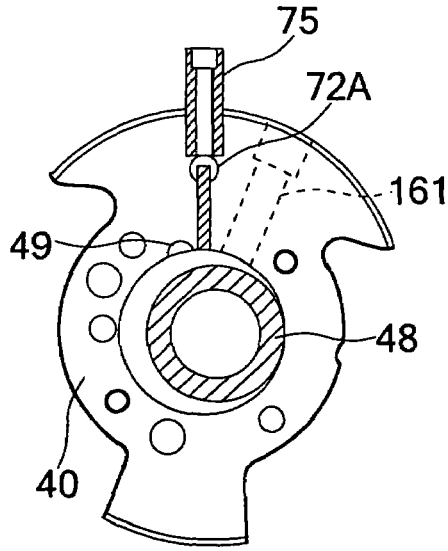
FIG. 6 is a sectional plan view of the second cylinder in a case where the second roller of the second rotary compression element rotates by 90° from the top dead center in the rotation direction in the multicylindrical rotary compressor of FIG. 1.

Furthermore, as shown in FIGS. 5 and 8, when the second roller 48 rotates by 70° from the top dead center, the opening 132A of the passage 132 is closed by the second vane 52. Therefore, the communication path 130 is closed, and the discharge of the high pressure into the second cylinder 40 is stopped. It is to be noted that when the second roller 48 rotates by 90° from the top dead center as shown in FIG. 6, the opening 132A of the passage is closed by the second vane 52 as described above. Therefore, the communication path 130 is closed, and the discharge of the high-pressure gas into the second cylinder 40 is stopped.

Additionally, when the refrigerant is compressed by the operations of the second roller 48 and the second vane 52, and a bottom dead center (rotated by 180° from the top dead center) is exceeded, the pressure in the cylinder 40 on the high-pressure chamber side constitutes a predetermined pressure, and is discharged from the discharge port 49.

Thereafter, when the second roller 48 rotates by 330° from the top dead center, the opening 131A of the passage 131 in the back-pressure chamber 72A is closed by the second vane 52. It is to be noted that the high-pressure refrigerant gas in the cylinder 40 is discharged until the second roller 48 passes through the discharge port 49. When the second roller 48 passes through the discharge port 49, the discharge of the refrigerant gas ends.

On the other hand, the refrigerant gas discharged from the high-pressure chamber side of the second cylinder 40 to the discharge sound muffling chamber 64 through the discharge port 49 is discharged to the discharge sound muffling chamber 62 via the communication path 120, and combined with the refrigerant compressed by the first rotary compression element 32. The combined refrigerant is discharged into the sealed container 12 from a hole (not shown) extending through the cup member 63.

Thereafter, the refrigerant in the sealed container 12 is discharged to the outside from the refrigerant discharge tube 96 formed in the end cap 12B of the sealed container 12, and flows into the exterior heat exchanger 152. Here, since the electromagnetic valve 106 of the pipe 102 is opened as described above, a part of the discharge-side refrigerant of each of the rotary compression elements 32, 34, passed through the refrigerant discharge tube 96, enters the pipe 75 from the refrigerant pipe 102, and is applied as the back pressure of the second vane 52.

On the other hand, the refrigerant gas which has flown into the exterior heat exchanger 152 releases heat there, a pressure of the gas is reduced by the expansion valve 154, and the gas flows into the interior heat exchanger 156. The refrigerant evaporates in the interior heat exchanger 156, and absorbs heat from air circulated in a room to thereby exert a cooling function and cool the room. Moreover, the refrigerant flows out of the interior heat exchanger 156, and is sucked into the rotary compressor 10. This cycle is repeated.

(2) Switching from First Operation Mode to Second Operation Mode (Operation under Light Load)

Next, when the inside of the room is brought from the above-described usual or high load state to a light load state, the controller 210 shifts from the first operation mode to the second operation mode. This second operation mode is a mode in which substantially the only first rotary compression element 32 performs the compression work. This operation mode is carried out in a case where the inside of the room has a light load, and the electromotive element 14 rotates at a low speed in the first operation mode. When substantially the only first rotary compression element 32 performs the compression work in a small capability region of the rotary compressor 10, an amount of the refrigerant gas to be compressed can be reduced as compared with a case where both of the first and second cylinders 38, 40 perform the compression work. Therefore, the rotation number of the electromotive element 14 is raised as much even under the light load, the operation efficiency of the electromotive element 14 is improved, and it is possible to reduce leakage losses of the refrigerant.

In this case, the controller 210 opens the electromagnetic valve 105 of the refrigerant pipe 101, and closes the electromagnetic valve 106 of the refrigerant pipe 102. Accordingly, the refrigerant pipe 101 communicates with the pipe 75, and the low-pressure refrigerant on the suction side of the first rotary compression element 32 flows into the back-pressure chamber 72A.

At this time, the high-pressure refrigerant on the discharge side applied to the back-pressure chamber 72A of the second vane 52 in the first operation mode remains in the back-pressure chamber 72A. Therefore, much time has heretofore been required until the pressure in the back-pressure chamber 72A of the second vane 52 switches to the low pressure. That is, the second vane 52 is pushed by the high-pressure gas left in the back-pressure chamber 72A, and enters the second cylinder 40. This causes a problem that the second vane 52 collides with the second roller 48 to generate collision noises.

However, when the communication path 130 is connected to a predetermined rotation region (a rotation angle range of 60° or more and less than 70° as described above in the present embodiment) of the second roller 48, and the high pressure in the back-pressure chamber 72A is discharged to the low-pressure chamber side of the second cylinder 40 as in the present invention, the high pressure in the back-pressure chamber 72A can be released to the low-pressure chamber side in the second cylinder 40.

Accordingly, the pressure in the back-pressure chamber 72A of the second vane 52 is quickly lowered, and the low pressure which is the suction-side pressure of the first rotary compression element 32 is applied as the back pressure of the second vane 52. Therefore, the second vane 52 can be retreated from the second cylinder 40 early, and it is possible to reduce the collision of the second vane 52 with the second roller 48.

It is to be noted that in the present embodiment, the communication path 130 is connected by the rotation by 60° in the rotating direction as described above. When the pressure in the back-pressure chamber 72A is discharged to the low-pressure chamber side in the second cylinder 40, and the roller rotates by 10° from the position (the second roller 48 rotates by 70° from the top dead center in the rotating direction), the communication path 130 is closed, and the discharging of the pressure to the low-pressure chamber side in the second cylinder 40 is stopped. Here, in such structure, in a case where the pressure of the back-pressure chamber 72A of the second roller 48 is higher than that of the low-pressure chamber side in the second cylinder 40, the second roller 48 always rotates by 60° in the rotating direction to discharge the pressure from the back-pressure chamber 72A into the second cylinder 40.

That is, when an amount of the pressure discharged from the back-pressure chamber 72A into the second cylinder 40 on the low-pressure chamber side increases, an amount of the low-pressure refrigerant sucked into the second cylinder 40 on the low-pressure chamber side is reduced, and a volume efficiency of the second rotary compression element 34 remarkably drops in the first operation mode. Therefore, when the opening 132A of the passage 132 is disposed in such a position to connect the communication path 130 only in a rotation region of the second roller 48 limited to a certain degree as in the present embodiment, the drop of the volume efficiency of the second rotary compression element 34 is suppressed, and it is possible to reduce noises at a time when the first operation mode is switched to the second operation mode.

Moreover, such noises can be reduced in a simple structure in which the intermediate partition plate 36 is provided with the communication path 130, increases of manufacturing costs can be avoided as much as possible. Accordingly, it is possible to reduce the noises at a low cost at the time when the first operation mode is switched to the second operation mode, and reliability of the rotary compressor 10 can be enhanced.

(3) Second Operation Mode

Next, there will be described an operation of the rotary compressor 10 in the second operation mode. The low-pressure refrigerant flows from the refrigerant pipe 100 of the rotary compressor 10 into the accumulator 146. In this case, since the electromagnetic valve 105 of the refrigerant pipe 101 is opened as described above, a part of the refrigerant of the first rotary compression element 32 on the suction side, passed through the refrigerant pipe 100, flows from the refrigerant pipe 101 into the back-pressure chamber 72A through the pipe 75. Accordingly, the back-pressure chamber 72A has the suction-side pressure of the first rotary compression element 32 as described above, and the suction-side pressure of the first rotary compression element 32 is applied as the back pressure of the second vane 52.

Moreover, the low-pressure refrigerant which has flown into the accumulator 146 is separated into the gas and the liquid, and thereafter the only refrigerant gas enters the refrigerant discharge tube 92 which opens in the accumulator 146. The low-pressure refrigerant gas which has entered the refrigerant introducing tube 92 is sucked into the low-pressure chamber side of the first cylinder 38 of the first rotary compression element 32 through the suction passage 58 and a suction port (not shown).

The refrigerant gas sucked into the low-pressure chamber side of the first cylinder 38 is compressed by the operations of the first roller 46 and the first vane 50 to constitute a high-temperature high-pressure refrigerant gas, and the gas is discharged from the high-pressure chamber side of the first cylinder 38 into the discharge sound muffling chamber 62 through a discharge port (not shown). The refrigerant gas discharged to the discharge sound muffling chamber 62 is discharged into the sealed container 12 through a hole (not shown) extending through the cup member 63.

Thereafter, the refrigerant in the sealed container 12 is discharged to the outside from the refrigerant discharge tube 96 formed in the end cap 12B of the sealed container 12, and flows into the exterior heat exchanger 152. The refrigerant gas which has flown into the exterior heat exchanger 152 releases the heat there, the pressure of the gas is reduced by the expansion valve 154, and the gas flows into the interior heat exchanger 156. In the interior heat exchanger 156, the refrigerant evaporates, and absorbs the heat from the air circulated in the room to exert the cooling function and cool the room. Moreover, the refrigerant flows out of the interior heat exchanger 156, and is sucked into the rotary compressor 10. This cycle is repeated.

It is to be noted that when the second roller 48 rotates by 60° from the top dead center in the rotating direction in the present embodiment, the communication path 130 communicates, and the pressure is discharged from the back-pressure chamber 72A into the low-pressure chamber side of the second cylinder 40. When the roller rotates by 10° from there (the second roller 48 rotates by 70° from the top dead center in the rotating direction), the communication path 130 is closed, and the discharging of the pressure to the low-pressure chamber side in the second cylinder 40 is stopped. However, the position of the communication path 130 is not limited to that of the present embodiment as long as the communication path 130 communicates in the only predetermined rotation range of the second roller 48, for example, in any position where the second roller 48 rotates by 20° to 120° from the top dead center, the pressure is discharged from the back-pressure chamber 72A to the low-pressure chamber side in the second cylinder 40, and thereafter the discharging of the pressure from the second cylinder 40 into the low-pressure chamber side is stopped.

Moreover, only in a case where the communication path 130 is provided with an opening/closing valve or the like to open/close the communication path, and the opening/closing valve is controlled to switch the first operation mode to the second operation mode, the opening/closing valve may open to open the communication path. In this case, since the pressure in the back-pressure chamber 72A is not discharged to the low-pressure chamber side of the second cylinder 40 in the first operation mode, it is possible to avoid the drop of the volume efficiency of the second rotary compression element 34.

Furthermore, the high pressure which is the refrigerant pressure of the discharge side of each of the rotary compression elements 32, 34 is applied as the back pressure of the second vane 52 in the first operation mode in the present embodiment, but, for example, a pressure (intermediate pressure) between the discharge-side refrigerant pressure and the suction-side refrigerant pressure may be applied as the back pressure of the second vane 52. In this case, for example, a valve device is disposed in an intermediate portion of the pipe 75, the valve device is closed, and the flowing of the refrigerant into the back-pressure chamber 72A is inhibited. Accordingly, a slight amount of the refrigerant flows into the back-pressure chamber 72A from both of the high and low pressure chamber sides in the second cylinder 40 via gaps in the second vane 52, and the inside of the back-pressure chamber 72A has an intermediate pressure between the suction-side pressure and the discharge-side pressure of each of the rotary compression elements 32, 34.

As described above, even in a case where the pipe 75 is provided with the valve device, the valve device is closed to stop the flowing of the high-pressure refrigerant from the pipe 75 into the back-pressure chamber 72A, and the inside of the back-pressure chamber 72A is set to the intermediate pressure, the second vane 52 can be sufficiently urged toward the second roller 48 without using any spring member. According to the present invention, when the first operation mode is switched to the second operation mode, the second vane 52 can be retreated from the second cylinder 40 early, and it is possible to reduce the collisions between the second vane 52 and the second roller 48.

Embodiment 2

Figure 10:
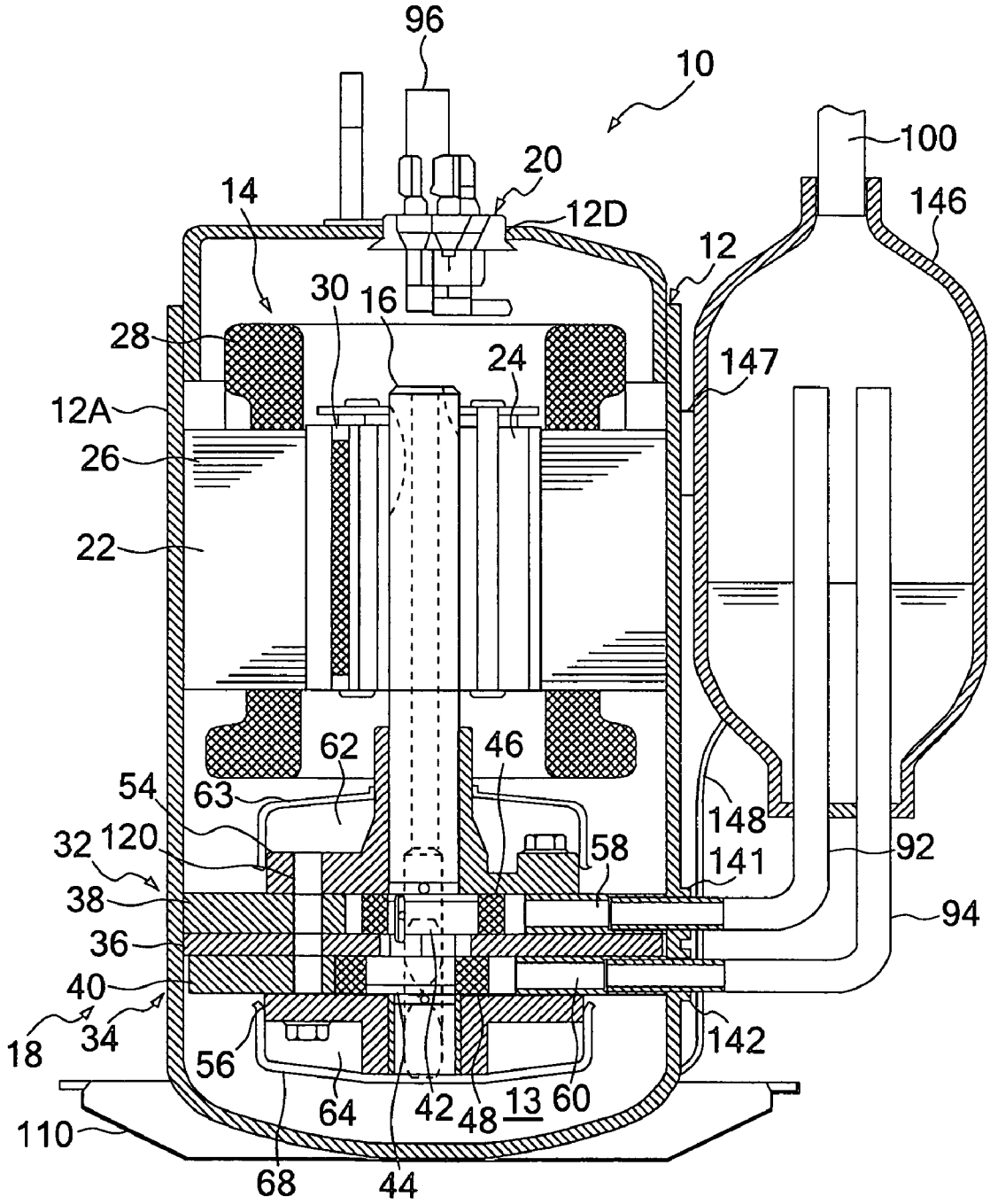
FIG. 10 is a vertical side view of a multicylindrical rotary compressor of a compression system according to another embodiment of the present invention.
Figure 11:
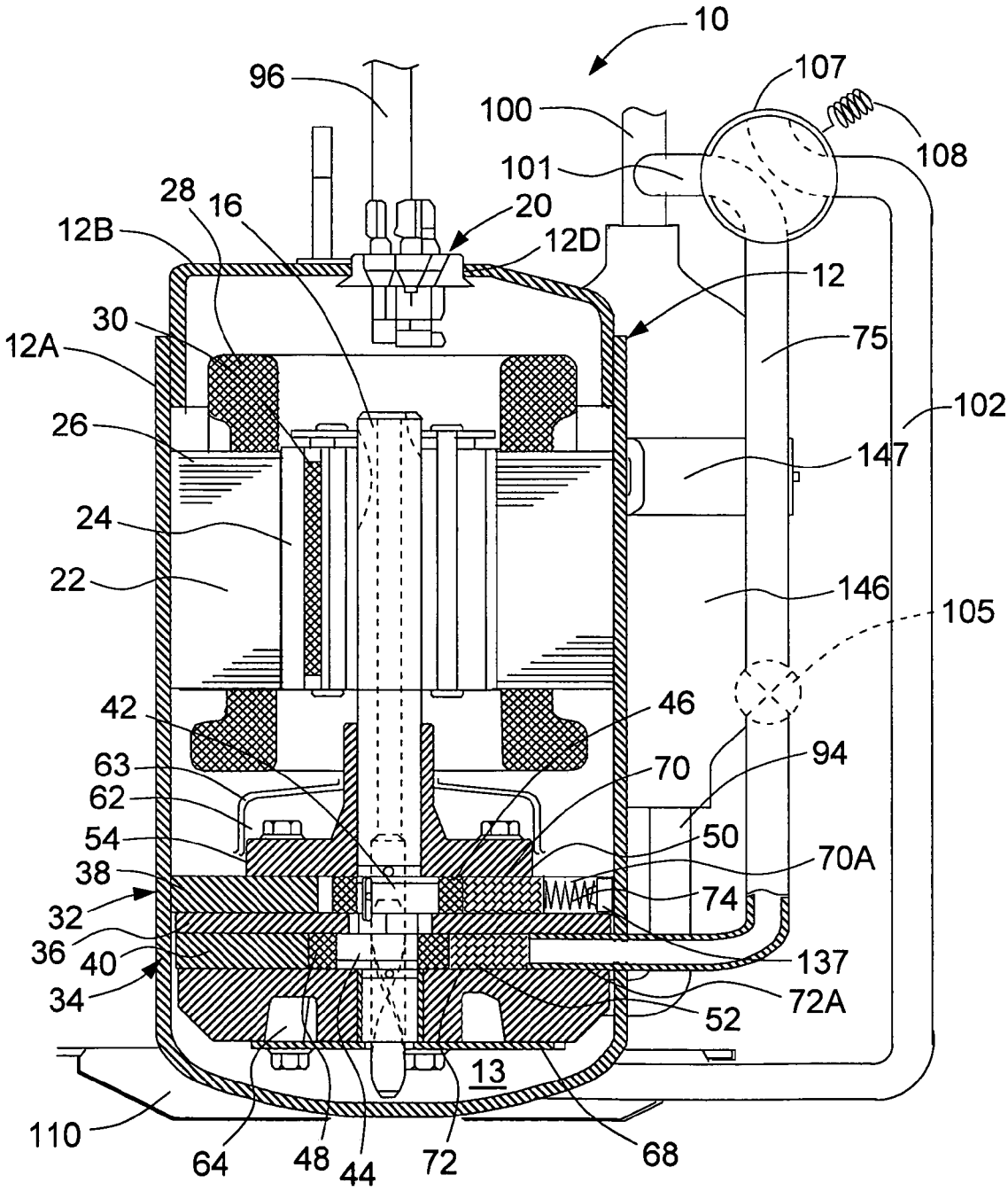
FIG. 11 is another vertical side view of the multicylindrical rotary compressor of FIG. 10.
Figure 12:
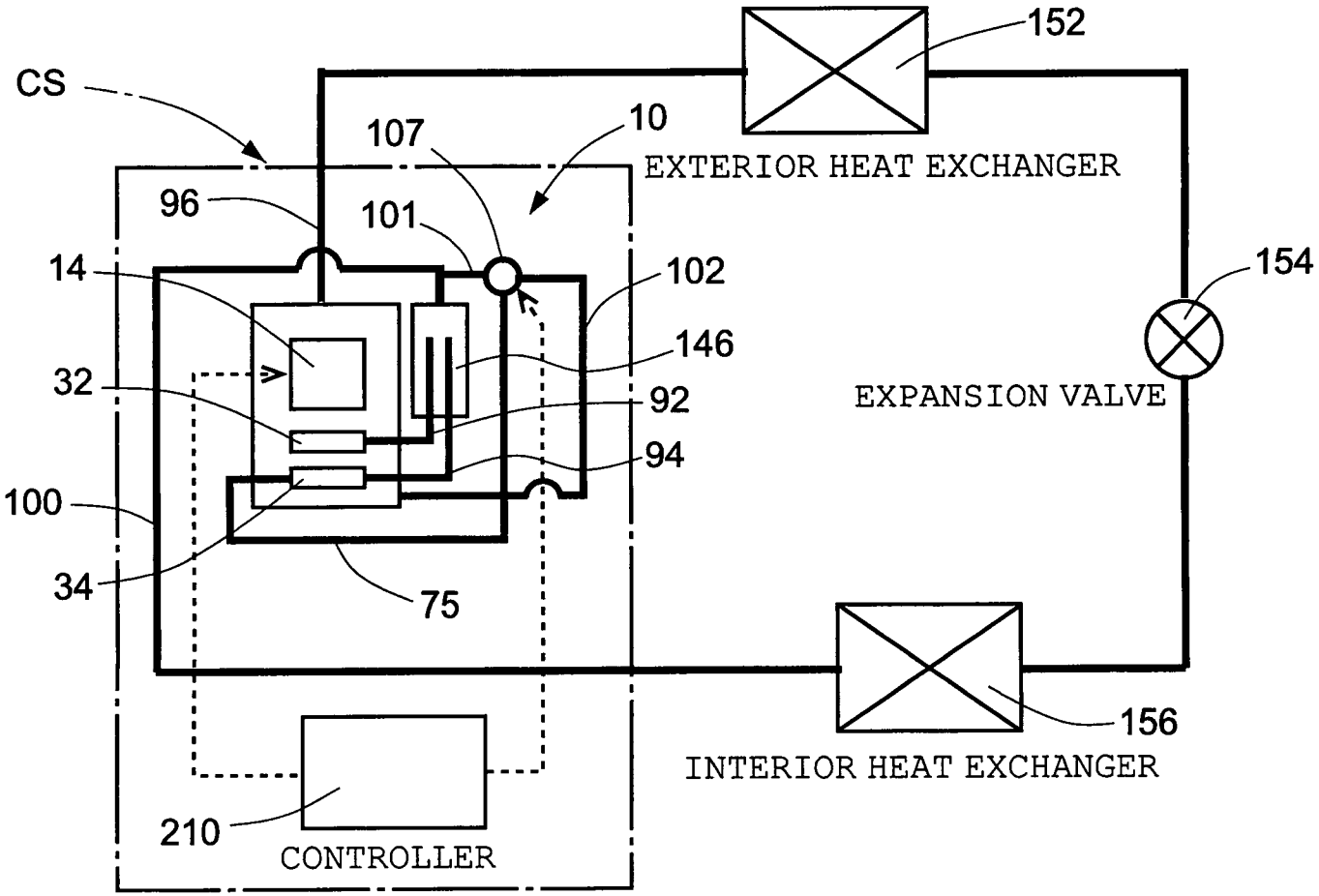
FIG. 12 is a refrigerant circuit diagram of an air conditioner using the compression system provided with the multicylindrical rotary compressor of FIG. 10.

Next, another embodiment of the present invention will be described. FIG. 10 shows a vertical side view of a high inner pressure type rotary compressor 10 provided with first and second rotary compression elements as an embodiment of a multicylindrical rotary compressor of a compression system CS according to the present invention, FIG. 11 shows a vertical side view (showing a section different from that of FIG. 10) of the rotary compressor 10 of FIG. 10, and FIG. 12 shows a refrigerant circuit diagram of an air conditioner constituted using the compression system CS. It is to be noted that the compression system CS of the present embodiment constitutes a part of a refrigerant circuit of the air conditioner as a freezing device which conditions the inside of a room in the same manner as in the above-described embodiment. It is to be noted that in FIGS. 10 and 12, components denoted with the same reference numerals as those of FIGS. 1 to 9 are regarded as components which produce similar effects, and description thereof is omitted.

In FIG. 10, reference numeral 13 denotes an oil reservoir formed in a bottom part of a sealed container 12, 148 denotes a communication tube connected to an inner bottom part of an accumulator 146, and oil accumulated in the accumulator 146 is returned to the oil reservoir 13 in the sealed container 12 via the communication tube 148.

On the other hand, a refrigerant pipe 101 is connected to an intermediate portion of a refrigerant pipe 100 whose one end is inserted into an upper part of the accumulator 146, and the pipe is connected to a four-way changeover valve 107. One end of a pipe 102 is also connected to the oil reservoir 13 in a bottom part of the sealed container 12. One end of the pipe 102 is connected to the oil reservoir 13 as described above, and rises upwards, and the other end thereof is connected to the four-way changeover valve 107 in the same manner as in the refrigerant pipe 101. The four-way changeover valve 107 is connected to a pipe 75. Moreover, a controller 210 is a control unit constituting a part of the compression system CS of the present invention, and controls a rotation number of an electromotive element 14 of the rotary compressor 10. Switching of the four-way changeover valve 107 is also controlled.

The four-way changeover valve 107 is switchable by a solenoid coil 108. That is, when a power supply is OFF, the four-way changeover valve 107 has a state in which the pipe 102 of the oil is connected to the pipe 75. When the power supply of the four-way changeover valve 107 is turned on based on an ON-signal from the controller 210, a magnetic field is generated in the solenoid coil 108. Accordingly, the four-way changeover valve 107 is switched to connect the refrigerant pipe 101 to the pipe 75. When an OFF-signal input from the controller 210, the power supply of the four-way changeover valve 107 is turned off, and the pipe 102 is connected to the pipe 75 via the four-way changeover valve 107 as described above.

Next, an operation of the rotary compressor 10 of the present embodiment constituted as described above will be described.

(1) First Operation Mode (at the Time of a Usual or High Load)

Figure 13:
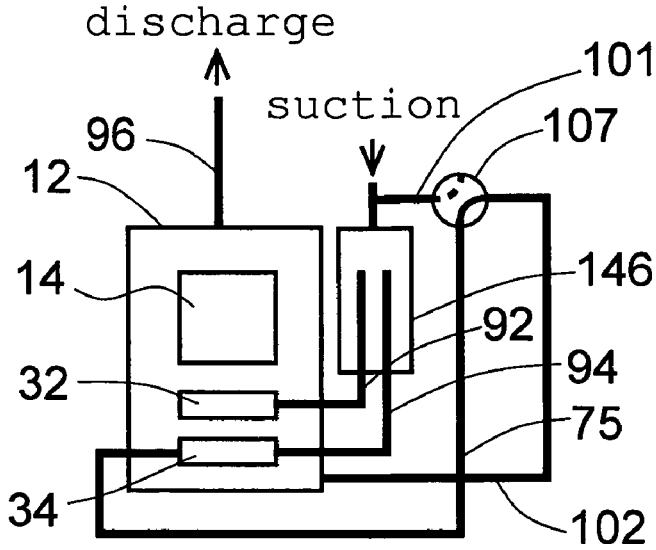
FIG. 13 is a diagram showing a flow of a refrigerant in the first operation mode of the multicylindrical rotary compressor of FIG. 10.

First, the first operation mode will be described in which both of rotary compression elements 32, 34 perform compression works. In a case where the controller 210 controls the rotation number of the electromotive element 14 of the rotary compressor 10 based on an operation instruction input of an interior controller (not shown) disposed in an interior unit described above, and the interior has a usual or high load state, the controller 210 executes the first operation mode. The four-way changeover valve 107 remains in the OFF-state. That is, the pipe 102 is connected to the pipe 75 via the four-way changeover valve 107 (FIG. 13).

Furthermore, when a stator coil 28 of the electromotive element 14 is energized via a terminal 20 and a wiring line (not shown), the electromotive element 14 starts, and the rotor 24 rotates. This rotation engages first and second rollers 46, 48 with upper and lower eccentric portions 42, 44 disposed integrally with a rotation shaft 16, and the rollers eccentrically rotate in first and second cylinders 38, 40.

Accordingly, a low-pressure refrigerant flows from the refrigerant pipe 100 of the rotary compressor 10 into the accumulator 146. Since the refrigerant pipe 101 is not connected to the pipe 75 via the four-way changeover valve 107 as described above, all the refrigerant passed through the refrigerant pipe 100 flows into the accumulator 146 without flowing into the pipe 75.

Moreover, the low-pressure refrigerant which has flown into the accumulator 146 is separated into a gas and a liquid. Thereafter, the only refrigerant gas enters refrigerant discharge tubes 92, 94 which open in the accumulator 146. The low-pressure refrigerant gas which has entered the refrigerant introducing tube 92 is sucked into the first cylinder 38 of the first rotary compression element 32 on a low-pressure chamber side via a suction passage 58.

The refrigerant gas sucked into the first cylinder 38 on the low-pressure chamber side is compressed by the operations of the first roller 46 and a first vane 50 to constitute a high-temperature high-pressure refrigerant gas, and the gas is discharged from the high-pressure chamber side of the first cylinder 38 to a discharge sound muffling chamber 62 through a discharge port (not shown).

On the other hand, the low-pressure refrigerant gas which has entered the refrigerant introducing tube 94 is sucked into the second cylinder 40 of a second rotary compression element 34 on the low-pressure chamber side via a suction passage 60. The refrigerant gas sucked into the second cylinder 40 on the low-pressure chamber side is compressed by the operations of the second roller 48 and the second vane 52.

At this time, since the pipe 102 is connected to the pipe 75 via the four-way changeover valve 107 as described above, the oil in the oil reservoir 13 is supplied to a back-pressure chamber 72A via the pipe 102, the four-way changeover valve 107, and the pipe 75. Since the oil has a high pressure in the same manner as in the sealed container 12, such high-pressure oil (hydraulic pressure) is applied as a back pressure of the second vane 52. Accordingly, the second vane 52 can be sufficiently urged with respect to the second roller 48 without using any spring member.

Figure 14:
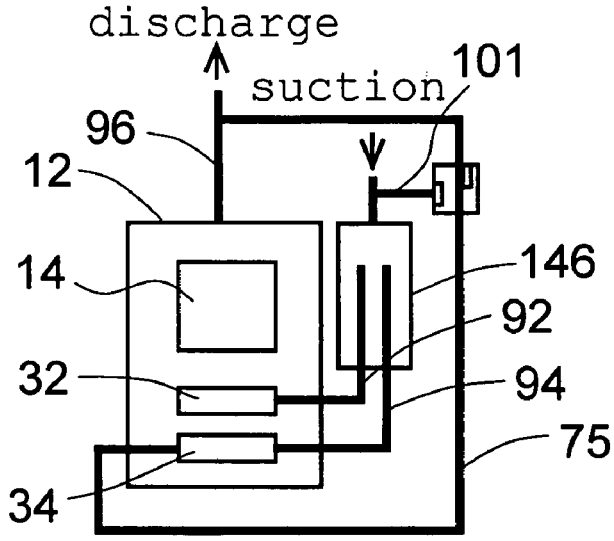
FIG. 14 is a diagram showing a flow of the refrigerant at the time of a two-cylinder operation in a conventional multicylindrical rotary compressor.

Heretofore, as shown in FIG. 14, the high-pressure refrigerant gas on the discharge side of each of the rotary compression elements 32, 34 has been applied as the back pressure of the second vane 52. However, in this case, since the discharge-side pressure has large pulsation, and any spring member is not disposed, there has occurred a problem that followability of the second vane 52 is deteriorated by this pulsation, and the refrigerant gas in the second cylinder 40 leaks from a gap in the second vane 52. Since rotation of the second roller 48 is delayed especially at a time when the roller rotates at a low speed, a leakage amount increases as much, and a compression efficiency remarkably drops.

However, in the present invention, when the oil of the oil reservoir 13 in the sealed container 12 is supplied to the back-pressure chamber 72A of the second vane 52, the refrigerant gas in the second cylinder 40 does not easily leak owing to a fluid difference (oil has a viscosity which is higher than that of the refrigerant gas) between the oil and the refrigerant gas, and leakages of the refrigerant gas can be remarkably reduced. Consequently, a compression efficiency in the second rotary compression element 34 can be improved.

It is to be noted that the high-temperature high-pressure refrigerant gas compressed by the operations of the second roller 48 and the second vane 52 is discharged from the high-pressure chamber side of the second cylinder 40 to a discharge sound muffling chamber 64 through a discharge port (not shown). The refrigerant gas discharged to the discharge sound muffling chamber 64 is discharged to the discharge sound muffling chamber 62 via the communication path 120, and combined with the refrigerant gas compressed by the first rotary compression element 32. Moreover, the combined refrigerant gas is discharged into the sealed container 12 from a hole (not shown) extending through a cup member 63. When the refrigerant compressed by the first and second rotary compression elements 32, 34 is discharged to the sealed container 12, the inside of the sealed container 12 can be set to a high pressure. The oil of the oil reservoir 13 in the bottom part of the sealed container 12 can be easily supplied to the back-pressure chamber 72A via the pipe 102 by use of a pressure difference.

Moreover, even in a case where the oil supplied to the back-pressure chamber 72A leaks into the second cylinder 40 via the gap of the second vane 52, the oil mixed in the high-pressure refrigerant gas can be separated while passing through the sealed container 12, and an amount of the oil discharged to the outside of the rotary compressor 10 can be reduced.

The refrigerant discharged into the sealed container 12 is discharged to the outside from a refrigerant discharge tube 96 formed in an end cap 12B of the sealed container 12, and flows into an exterior heat exchanger 152. There, the refrigerant gas releases heat, a pressure of the gas is reduced by an expansion valve 154, and the gas flows into an interior heat exchanger 156. The refrigerant evaporates in the interior heat exchanger 156, and absorbs heat from air circulated in a room to thereby exert a cooling function and cool the room. Moreover, the refrigerant flows out of the interior heat exchanger 156, and is sucked into the rotary compressor 10. This cycle is repeated.

It is to be noted that in the present embodiment, the high-pressure oil is supplied to the back-pressure chamber 72A in the first operation mode, but the present invention is not limited to this mode. For example, the pipe 75 may be provided with an electromagnetic valve 105 as a valve device as shown by a broken line in FIG. 2, and the electromagnetic valve 105 may be closed to set the inside of the back-pressure chamber 72A to an intermediate pressure. That is, after supplying the oil into the back-pressure chamber 72A as described above, the electromagnetic valve 105 is closed by the controller 210 to stop the flowing of the oil into the back-pressure chamber 72A. In this case, the oil supplied to the back-pressure chamber 72A remains in the back-pressure chamber 72A.

Moreover, an ON-signal is transmitted to the four-way changeover valve 107, and the power supply of the four-way changeover valve 107 is turned ON by the controller 210. Accordingly, a magnetic field of the solenoid coil 108 is generated, the four-way changeover valve 107 is switched, and the refrigerant pipe 101 is connected to the pipe 75. In this case, the high-pressure oil remaining in the pipe 75 enters the refrigerant pipe 101 via the four-way changeover valve 107 owing to a pressure difference. The oil enters the accumulator 146 together with the low-pressure refrigerant gas in the refrigerant pipe 100. After the oil is once stored in the accumulator 146, the oil is returned from the communication tube 148 into the oil reservoir 13 in the sealed container 12.

It is to be noted that in this case, since the electromagnetic valve 105 is closed, all the suction-side refrigerant flowing through the refrigerant pipe 100 flows into the accumulator 146 without flowing into the back-pressure chamber 72A as described above. On the other hand, since not a little oil flows into the back-pressure chamber 72A from both of the high and low pressure chamber sides of the second cylinder 40 via the gap of the second vane 52, the pressure in the back-pressure chamber 72A of the second vane 52 is an intermediate pressure between the suction-side pressure and the discharge-side pressure of each of the rotary compression elements 32, 34.

As described above, when the pipe 75 is provided with the electromagnetic valve 105, the electromagnetic valve 105 is closed, and the high-pressure oil is inhibited from being supplied from the pipe 75 to set the inside of the back-pressure chamber 72A to the intermediate pressure, the second vane 52 can be sufficiently urged with respect to the second roller 48 without using any spring member in the same manner as described above.

Furthermore, pressure pulsations can be reduced by effects of the oil and the intermediate pressure in the back-pressure chamber 72A, and followability of the second vane 52 can be enhanced more as compared with a case where the high-pressure oil in the sealed container 12 is supplied.

(2) Second Operation Mode (Operation under Light Load)

Next, when the inside of the room changes from the usual or high load state to the light load state, the controller 210 shifts from the first operation mode to the second operation mode. This second operation mode is a mode in which substantially the only first rotary compression element 32 performs the compression work. This operation mode is carried out in a case where the inside of the room has a light load, and the electromotive element 14 rotates at a low speed in the first operation mode. When substantially the only first rotary compression element 32 performs the compression work in a small capability region of the compression system CS, an amount of the refrigerant gas to be compressed can be reduced as compared with a case where both of the first and second cylinders 38, 40 perform the compression work. Therefore, the rotation number of the electromotive element 14 is raised as much even under the light load, the operation efficiency of the electromotive element 14 is improved, and it is possible to reduce leakage losses of the refrigerant. It is to be noted that at a time when the mode is switched, the controller 210 rotates the electromotive element 14 at a low speed, and executes a control in such a manner as to set a rotation number to 40 Hz or less and a compression ratio to 3.0 or less.

First, the ON-signal is input into the four-way changeover valve 107, and the power supply of the four-way changeover valve 107 is turned ON by the controller 210. Accordingly, the magnetic field of the solenoid coil 108 is generated, the four-way changeover valve 107 is switched, the refrigerant pipe 101 is connected to the pipe 75, the suction-side refrigerant of the first rotary compression element 32 flows into the back-pressure chamber 72A, and the suction-side pressure of the first rotary compression element 32 is applied as the back pressure of the second vane 52.

On the other hand, the controller 210 energizes the stator coil 28 of the electromotive element 14 via the terminal 20 and a wiring line (not shown) as described above, and rotates the rotor 24 of the electromotive element 14. According to this rotation, the first and second rollers 46, 48 are fitted with the upper and lower eccentric portions 42, 44 disposed integrally with the rotation shaft 16 to eccentrically rotate in the first and second cylinders 38, 40.

Accordingly, the low-pressure refrigerant flows from the refrigerant pipe 100 of the rotary compressor 10 into the accumulator 146. In this case, since the refrigerant pipe 101 is connected to the pipe 75 via the four-way changeover valve 107 as described above, a part of the suction-side refrigerant of the first rotary compression element 32, passed through the refrigerant pipe 100, flows from the refrigerant pipe 101 into the back-pressure chamber 72A via the pipe 75. Accordingly, the back-pressure chamber 72A obtains the suction-side pressure of the first rotary compression element 32, and the suction-side pressure of the first rotary compression element 32 is applied as the back pressure of the second vane 52.

As described above, when the suction-side pressure of the first rotary compression element 32 is applied as the back pressure of the second vane 52, the refrigerant pressure sucked into the second cylinder 40 is a low pressure equal to the back pressure of the second vane 52. Therefore, the second vane 52 cannot follow the second roller 48. Accordingly, since the second vane 52 retreats from the second cylinder 40, and the refrigerant cannot be compressed by the second rotary compression element 34, the refrigerant is compressed by the only first rotary compression element 32.

It is to be noted that heretofore the high-pressure refrigerant gas on the discharge side of each of the rotary compression elements 32, 34 having large pulsation is applied as the back pressure of the second rotary compression element 34. In this case, since the discharge-side high-pressure refrigerant applied to the back-pressure chamber 72A of the second vane 52 in the first operation mode remains in the back-pressure chamber 72A, much time is required until the inside of the back-pressure chamber 72A of the second vane 52 changes to the low pressure. That is, the second vane 52 is pushed by the high-pressure gas left in the back-pressure chamber 72A, and enters the second cylinder 40. Therefore, the second vane 52 cannot be retreated from the second cylinder 40 early.

However, in a case where the oil is supplied to the back-pressure chamber 72A in the first operation mode as in the present invention, since the above-described pulsations are reduced, the second vane 52 can be retreated from the second cylinder 40 early, and it is possible to reduce collisions between the second vane 52 and the second roller 48.

It is to be noted that the oil (high pressure) supplied to the back-pressure chamber 72A in the first operation mode flows out of the back-pressure chamber 72A owing to the pressure difference from the suction-side pressure, enters the refrigerant pipe 101 via the pipe 75 and the four-way changeover valve 107, and further enters the accumulator 146 together with the low-pressure refrigerant gas in the refrigerant pipe 100. After the oil is once stored in the accumulator 146, it is returned from the communication tube 148 back into the oil reservoir 13 in the sealed container 12.

On the other hand, after the low-pressure refrigerant that has flown into the accumulator 146 is separated into a gas and a liquid, the only refrigerant gas enters the refrigerant introducing tube 92 that opens in the accumulator 146. The low-pressure refrigerant gas which has entered the refrigerant introducing tube 92 is sucked into the low-pressure chamber side of the first cylinder 38 of the first rotary compression element 32 via the suction passage 58.

The refrigerant gas sucked into the low-pressure chamber side of the first cylinder 38 is compressed by the operations of the first roller 46 and the first vane 50 to constitute a high-temperature high-pressure refrigerant gas. The gas is discharged from the high-pressure chamber side of the first cylinder 38 into the discharge sound muffling chamber 62 through a discharge port (not shown). In this case, since the discharge sound muffling chamber 62 functions as an expandable muffling chamber, and the discharge sound muffling chamber 64 functions as a resonant muffling chamber in the second operation mode, it is possible to reduce pressure pulsations of the refrigerant compressed by the first rotary compression element 32. Consequently, a sound muffling effect can be enhanced more in the second operation mode in which substantially the only first rotary compression element 32 performs the compression work.

The refrigerant gas discharged to the discharge sound muffling chamber 62 is discharged into the sealed container 12 via a hole (not shown) extending through the cup member 63. Thereafter, the refrigerant in the sealed container 12 is discharged to the outside from the refrigerant discharge tube 96 formed in the end cap 12B of the sealed container 12, and flows into the exterior heat exchanger 152. After the refrigerant gas discharges heat in the heat exchanger, and the pressure is reduced by the expansion valve 154, the gas flows into the interior heat exchanger 156. The refrigerant evaporates in the interior heat exchanger 156, and absorbs the heat from the air circulated in the room to thereby exert the cooling function and cool the room. Moreover, the refrigerant flows out of the interior heat exchanger 156, and is sucked into the rotary compressor 10. This cycle is repeated.

As described above in detail, according to the present invention, it is possible to enhance a performance and reliability of the compression system CS provided with the rotary compressor 10 constituted to be usable by switching the first operation mode in which the first and second rotary compression elements 32, 34 perform the compression work and the second operation mode in which substantially the only the first rotary compression element 32 performs the compression work.

Consequently, when a refrigerant circuit of an air conditioner is constituted using such compression system CS, the operation efficiency and performance of the air conditioner are enhanced, and power consumption can be reduced.

Embodiment 3

It is to be noted that in the above-described embodiment, when a power supply is OFF, an four-way changeover valve 107 is brought into a state in which a pipe 102 of oil communicates with a pipe 75. When the power supply of the four-way changeover valve 107 is turned on based on an ON-signal from a controller 210, a refrigerant pipe 101 is connected to the pipe 75. However, the refrigerant pipe 101 may be connected to the pipe 75 in a case where the power supply is OFF, and the oil pipe 102 may be connected to the pipe 75 in a case where the power supply of the four-way changeover valve 107 is turned ON based on the ON-signal from the controller 210.

Here, an operation will be described in which the inside of a back-pressure chamber 72A is set to an intermediate pressure, and a second vane 52 is urged toward a second roller 48 by the intermediate pressure in a first operation mode. After oil is supplied into the back-pressure chamber 72A as described above (in this case, the power supply of the four-way changeover valve 107 is turned on to connect the pipe 102 to the pipe 75), the controller 210 closes an electromagnetic valve 105 (shown by a broken line of FIG. 2), and the oil is inhibited from flowing into the back-pressure chamber 72A. Next, the controller 210 transmits an OFF signal to the four-way changeover valve 107. Accordingly, the power supply of the four-way changeover valve 107 is turned off, the four-way changeover valve 107 is switched, and the refrigerant pipe 101 is connected to the pipe 75. In this case, the high-pressure oil remaining in the pipe 75 enters the refrigerant pipe 101 via the four-way changeover valve 107 owing to the pressure difference. The oil then enters an accumulator 146 together with a low-pressure refrigerant gas in a refrigerant pipe 100, and is once stored in the accumulator 146. Thereafter, the oil is returned from a communication tube 148 back into an oil reservoir 13 in a sealed container 12.

It is to be noted that in this case, since the electromagnetic valve 105 is closed, all the suction-side pressure flowing through the refrigerant pipe 100 flows into the accumulator 146 without flowing into the back-pressure chamber 72A. On the other hand, since not a little oil flows into the back-pressure chamber 72A from both of the high and low pressure chamber sides of the second cylinder 40 via the gap of the second vane 52, the pressure in the back-pressure chamber 72A of the second vane 52 is an intermediate pressure between the suction-side pressure and the discharge-side pressure of each of the rotary compression elements 32, 34.

As described, when the pipe 75 is provided with the electromagnetic valve 105, the electromagnetic valve 105 is closed to stop the high-pressure oil from being supplied from the pipe 75, and the inside of the back-pressure chamber 72A is set to the intermediate pressure, the second vane 52 can be sufficiently urged with respect to the second roller 48 without using any spring member in the same manner as described above. Moreover, it is possible to reduce pressure pulsations by effects of the oil and the intermediate pressure in the back-pressure chamber 72A, and followability of the second vane 52 can be enhanced more.

Embodiment 4

In the above-described embodiments, an HFC or HC-based refrigerant is used as the refrigerant, but a refrigerant such as carbon dioxide having a large pressure difference, such as carbon dioxide combined with polyalkyl glycol (PAG), may be used. In this case, the refrigerant compressed by each of rotary compression elements 32, 34 has a very high pressure. Therefore, when a discharge sound muffling chamber 62 is formed into such a shape to cover an upper support member 54 from above by means of a cup member 63, the cup member 63 might be broken by such high pressure.

To solve a problem, the discharge sound muffling chamber above the upper support member 54 in which the refrigerants compressed by both of the rotary compression elements 32, 34 are combined is formed into a recessed portion above the upper support member 54, and the recessed portion is closed with a cover having a predetermined thickness. According to this constitution, the present invention is applicable even to a case where a refrigerant having a large pressure difference, such as carbon dioxide, is contained.

It is to be noted that the embodiments have been described above using the rotary compressor in which the rotation shaft 16 is of a vertically disposed type, but, needless to say, the present invention is applicable to the use of the rotary compressor in which the rotation shaft is of a horizontally laid type.

Furthermore, in the above-described embodiments, the two-cylinder rotary compressor is used, but, needless to say, the present invention may be applied to a compression system provided with a multicylindrical rotary compressor including three or more rotary compression elements.

What is claimed is:

1. A multicylindrical rotary compressor comprising:

a sealed container in which a driving element and first and second rotary compression elements driven by a rotation shaft of the driving element are contained, the first and second rotary compression elements including:

first and second cylinders;

first and second rollers engaged with eccentric portions formed on the rotation shaft to rotate eccentrically in the respective cylinders, respectively; and first and second vanes which abut on the first and second rollers to divide each cylinder into a low-pressure chamber side and a high-pressure chamber side, the compressor being constituted to be usable by urging the only first vane with respect to the first roller by means of a spring member, and switching a pressure to be applied to a back-pressure chamber of the second vane to switch a first operation mode in which both of the rotary compression elements perform compression works and a second operation mode in which substantially the only first rotary compression element performs the compression work, wherein the pressure in the back-pressure chamber of the second vane is discharged to the low-pressure chamber side in the second cylinder in a case where the first operation mode is switched to the second operation mode.

2. The mutlicylindrical rotary compressor according to claim 1, further comprising:

a communication path which connects the low-pressure chamber side in the second cylinder to the back-pressure chamber of the second vane, the communication path being connected in an only predetermined rotation region of the second roller.

* * * * *